US006593397B2

(12) United States Patent
Chang

(10) Patent No.: US 6,593,397 B2
(45) Date of Patent: Jul. 15, 2003

(54) FURAN NO-BAKE FOUNDRY BINDERS AND THEIR USE

(75) Inventor: Ken K. Chang, Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/238,176

(22) Filed: Sep. 10, 2002

(65) Prior Publication Data

US 2003/0036583 A1 Feb. 20, 2003

Related U.S. Application Data

(62) Division of application No. 09/519,025, filed on Mar. 3, 2000, now Pat. No. 6,479,567.

(51) Int. Cl.[7] ..... B22C 1/22
(52) U.S. Cl. ..... 523/144; 523/145; 523/147
(58) Field of Search ..... 523/144, 145, 523/147, 148, 146; 524/593, 594, 601, 604, 605

(56) References Cited

U.S. PATENT DOCUMENTS 4,371,648 A * 2/1983 Gardikes et al. ..... 523/144
4,761,441 A * 8/1988 Woodson ..... 523/439
4,946,876 A * 8/1990 Carpenter et al. ..... 523/143
5,856,375 A * 1/1999 Chang et al. ..... 523/145
6,391,942 B1 * 5/2002 Chang et al. ..... 523/144
6,479,567 B1 * 11/2002 Chang et al. ..... 523/144

* cited by examiner

*Primary Examiner*—Edward J. Cain
*Assistant Examiner*—Katarzyna Wyrozebski Lee
(74) *Attorney, Agent, or Firm*—David L. Hedden

(57) ABSTRACT

This invention relates to furan no-bake foundry binders comprising (a) furfuryl alcohol and/or a reactive furan resin, (b) an activator selected from the group consisting of resorcinol, resorcinol pitch, and bisphenol A tar (c) a bisphenol compound (d) a polyol selected from the group consisting of polyester polyols, polyether polyols, and mixtures thereof, and preferably (e) a silane. The binders are cured in the presence of the furan curing catalyst. The invention also relates to foundry mixes prepared with the binder, foundry shapes prepared with the foundry mix, and metal castings prepared with the foundry shapes.

11 Claims, No Drawings

FURAN NO-BAKE FOUNDRY BINDERS AND THEIR USE

This application is a division of application Ser. No. 09/519,025, filed Mar. 3, 2000 now U.S. Pat. No. 6,479,567.

FIELD OF THE INVENTION

This invention relates to furan no-bake foundry binders comprising (a) furfuryl alcohol and/or a reactive furan resin, (b) an activator selected from the group consisting of resorcinol, resorcinol pitch, and bisphenol A tar (c) a bisphenol compound (d) a polyol selected from the group consisting of polyester polyols, polyether polyols, and mixtures thereof, and preferably (e) a silane. The binders are cured in the presence of the furan curing catalyst. The invention also relates to foundry mixes prepared with the binder, foundry shapes prepared with the foundry mix, and metal castings prepared with the foundry shapes.

BACKGROUND OF THE INVENTION

One of the most commercially successful no-bake binders is the phenolic-urethane no-bake binder. This binder provides molds and cores with excellent strengths that are produced in a highly productive manner. Although this binder produces good cores and molds at a high speed, there is an interest in binders that have less volatile organic compounds (VOC), free phenol level, low formaldehyde, and that produce less odor and smoke during core making and castings. Furan binders have these advantages, but their cure speed is much slower than the cure speed of phenolic urethane no-bake binders. Furan binders have been modified to increase their reactivity, for instance by incorporating with urea-formaldehyde resins, phenol-formaldehyde resins, novolac resins, phenolic resole resins, and resorcinol into the binder. Nevertheless, these modified furan binders system do not provide the cure speed needed in foundries that require high productivity.

U.S. Pat. No. 5,856,375 discloses the use of BPA tar in furan no-bake binders to increase the cure speed of the furan binder. Although the cure speed of the binder is increased by the addition of the BPA tar, the tensile strength of this system does not match that of the phenolic urethane system.

SUMMARY OF THE INVENTION

This invention relates to furan no-bake binders comprising:

(a) furfuryl alcohol and/or a reactive furan resin, (b) an activator selected from the group consisting of resorcinol, resorcinol pitch, and bisphenol A tar, (c) a bisphenol compound, (d) a polyol selected from the group consisting of aromatic polyester polyols, polyether polyols, and mixtures thereof, and preferably (e) a silane.

The binders display several advantages when compared to a conventional furan no-bake binder. Cores prepared with the binders cure much faster than those prepared with conventional furan no-bake binders. In fact, the cure speed of cores prepared by the binders of this invention is comparable to that of the phenolic urethane no-bake binder, which is used commercially to make cores where high-speed production is needed. Additionally, the cores made with the binder display excellent tensile strength, and are advantageous from an environmental standpoint because they do not contain free phenol, have low formaldehyde, and contain no solvents or isocyanate.

ENABLING DISCLOSURE AND BEST MODE

The binder contains furfuryl alcohol and/or a reactive furan resin, preferably a mixture thereof. Reactive furan resins that can be used in the no-bake binders are preferably low nitrogen furan resins. The furan resins are prepared by the homopolymerization of furfuryl alcohol or the homopolymerization of bis-hydroxymethylfuran in the presence of heat, according to methods well-known in the art. The reaction temperature used in making the furan resins typically ranges from 95° C. to 105° C. The reaction is continued until the percentage of free formaldehyde is less than 5 weight percent, typically from 3 to 5 weight percent, and the refractive index is from 1.500 to about 1.600. The viscosity of the resin is preferably from about 200 cps to 450 cps. The furan resins have an average degree of polymerization of 2–3.

Preferably, a reactive furan resin, diluted with furfuryl alcohol to reduce the viscosity of the reactive furan resin, is used.

Although not necessarily preferred, modified furan resins can also be used in the binder. Modified furan resins are typically made from furfuryl alcohol, phenol, and formaldehyde at elevated temperatures under essentially alkaline conditions at a pH of from 8.0 to 9.0, preferably 8.4 to 8.7. The weight percent of furfuryl alcohol used in making the nitrogen free modified furan resins ranges from 50 to 65 percent; the weight percent of the phenol used in making the nitrogen free modified furan resins ranges from 10 to 25 percent; and the weight percent of the formaldehyde used in making the nitrogen free modified furan resins ranges from 15 to 25 percent, where all weight percents are based upon the total weight of the components used to make the modified furan resin.

Although not necessarily preferred, urea-formaldehyde resins, phenol-formaldehyde resins, novolac resins, and phenolic resole resins may also be used in addition to the furan resin.

The activator, which promotes the polymerization of furfuryl alcohol) is selected from the group consisting of resorcinol, resorcinol pitch, and bisphenol A tar. Preferably used as the activator is resorcinol. Resorcinol pitch is defined as the highly viscous product, which remains on the bottom of the reaction vessel after resorcinol is produced and distilled from the reaction vessel. Resorcinol pitch is a solid at room temperature and has a melting point of about 70° C. to 80° C. Resorcinol pitch is mostly dimers, trimers, and polymeric resorcinol. It may also contain substituted materials. Bisphenol A tar is defined as the highly viscous product, which remains on the bottom of the reaction vessel after bisphenol A is produced and distilled from the reaction vessel. The bisphenol A tar is a solid at room temperature and has a melting point of about 70° C. to 80° C. Bisphenol A tar is mostly dimers, trimers, and polymeric bis phenol A. It may also contain substituted materials.

The bisphenol compound used is bisphenol A, B, F, G, and H, but preferably is bisphenol A.

The polyol is selected from the group consisting of polyester polyols, polyether polyols, and mixtures thereof. Aliphatic polyester polyols can be used in the binder. Aliphatic polyester polyols are well known and prepared by reacting a dicarboxylic acid or anhydride with a glycol. They generally have an average hydroxyl functionality of at least 1.5. Preferably, the average molecular weight of the polyester polyol is from 300 to 800. Typical dicarboxylic acids preferably used to prepare the polyester polyols are adipic acid, oxalic acid, and isophthalic acid. The glycols typically used to prepare the polyester polyols are ethylene glycol, diethylene glycol and propylene glycol.

The polyether polyols that are used are liquid polyether polyols or blends of liquid polyether polyols having a hydroxyl number of from about 200 to about 600, preferably about 300 to about 500 milligrams of KOH based upon one gram of polyether polyol. The viscosity of the polyether polyol is from 100 to 1,000 centipoise, preferably from 200 to 700 centipoise, most preferably 300 to 500 centipoise. The polyether polyols may have primary and/or secondary hydroxyl groups.

These polyether polyols are commercially available and their method of preparation and determining their hydroxyl value is well known. The polyether polyols are prepared by reacting an alkylene oxide with a polyhydric alcohol in the presence of an appropriate catalyst such as sodium methoxide according to methods well known in the art. Any suitable alkylene oxide or mixtures of alkylene oxides may be reacted with the polyhydric alcohol to prepare the polyether polyols. The alkylene oxides used to prepare the polyether polyols typically have from two to six carbon atoms. Representative examples include ethylene oxide, propylene oxide, butylene oxide, amylene oxide, styrene oxide, or mixtures thereof. The polyhydric alcohols typically used to prepare the polyether polyols generally have a functionality greater than 2.0, preferably from 2.5 to 5.0, most preferably from 2.5 to 4.5. Examples include ethylene glycol, diethylene glycol, propylene glycol, trimethylol propane, and glycerine.

Although aliphatic polyester polyols and polyether polyols can be used in the binder, preferably the polyol used in the polyol component are liquid aromatic polyester polyols, or a blend of liquid aromatic polyester polyols, generally having a hydroxyl number from about 500 to 2,000, preferably from 700 to 1200, and most preferably from 250 to 600; a functionality equal to or greater than 2.0, preferably from 2 to 4; and a viscosity of 500 to 50,000 centipoise at 25° C., preferably 1,000 to 35,000, and most preferably 2,000 to 25,000 centipoise. They are typically prepared by the ester interchange of an aromatic ester and a polyol in the presence of an acidic catalyst. Examples of aromatic esters used to prepare the aromatic polyesters include phthalic anhydride and polyethylene terephthalate. Examples of polyols used to prepare the aromatic polyesters are ethylene glycol, diethylene glycol, triethylene glycol, 1,3, propane diol, 1,4 butane diol, dipropylene glycol, tripropylene glycol, tetraethylene glycol, glycerin, and mixtures thereof. Examples of commercial available aromatic polyester polyols are STEPANPOL polyols manufactured by Stepan Company, TERATE polyol manufactured by Hoechst-Celanese, THANOL aromatic polyol manufactured by Eastman Chemical, and TEROL polyols manufactured by Oxide Inc.

It is highly preferred to include a silane in binder. Silanes that can be used can be represented by the following structural formula:

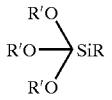

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. Examples of some commercially available silanes are Dow Corning Z6040; Union Carbide A-1100 (gamma aminopropyltriethoxy silane); Union Carbide A-1120 (N-beta(aminoethyl)-gamma-aminopropyltrimethoxy silane); and Union Carbide A-1160 (ureido-silane).

The components are used in the following amounts: (a) from about 1 to about 50 parts by weight a reactive furan resin, preferably about 2 to 30 parts, most preferably from 6–22 parts (b) from about 10 to about 80 parts by weight furfuryl alcohol, preferably about 20 to 75, most preferably from 22 to 70, (c) from about 0.1 to about 20 parts by weight resorcinol, preferably from about 0.5 to 10, most preferably from 0.6–8 (d) from about 1 to about 30 parts by weight a bisphenol, preferably from about 2–15, most preferably from 3–12 (e) from about 0.1 to about 30 parts of a polyester polyol, preferably from about 2 to 20, most preferably from 3 to 15 and (f) from about 0.01 to about 10 parts by weight a silane, preferably about 0.05 to about 5, most preferably from 0.07–3.

In general, any inorganic or organic acids, preferably organic acids, can be used as furan curing catalysts. Preferably, the curing catalyst is a strong acid such as toluene sulfonic acid, xylene sulfonic acid, benzene sulfonic acid, HCl, and H2SO4. Weak acid such as phosphoric acid can also be used. The amount of curing catalyst used is amount effective to result in foundry shapes that can be handled without breaking. Generally, this amount is from 1 to 45 weight percent based upon the weight of total binder, typically from 10 to 40, preferably 15 to 35 weight percent. Preferably the mixture of toluene sulfonic acid/benzene sulfonic acid is been used.

It will be apparent to those skilled in the art that other additives such as release agents, solvents, benchlife extenders, silicone compounds, etc. can be used and may be added to the binder composition, aggregate, or foundry mix.

The aggregate used to prepare the foundry mixes is that typically used in the foundry industry for such purposes or any aggregate that will work for such purposes. Generally, the aggregate is sand, which contains at least 70 percent by weight silica. Other suitable aggregate materials include zircon, alumina-silicate sand, chromite sand, and the like. Generally, the particle size of the aggregate is such that at least 80 percent by weight of the aggregate has an average particle size between 40 and 150 mesh (Tyler Screen Mesh).

The amount of binder used is an amount that is effective in producing a foundry shape that can be handled or is self-supporting after curing. In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Although it is possible to mix the components of the binder with the aggregate in various sequences, it is preferred to add the curing acid catalyst to the aggregate and mix it with the aggregate before adding the binder.

Generally, curing is accomplished by filling the foundry mix into a pattern (e.g. a mold or a core box) to produce a workable foundry shape. A workable foundry shape is one that can be handled without breaking.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

ABBREVIATIONS

The following abbreviations are used in the Examples:

| | |
|---|---|
| Bis A | bisphenol A |
| CAT | toluene sulfonic acid/benzene sulfonic acid (50:50) |
| FA | furfuryl alcohol |
| FURAN | furan resin having an average degree of polymerization of about 2–3, prepared by the homopolymerization of furfuryl alcohol under basic conditions at a reflux temperature of about 100° C. |
| PP | a polyester polyol prepared by reacting dimethyl terephthalate (DMT) with diethylene glycol, such that the average molecular weight of the polyester polyol is about 600 |
| RES | resorcinol |
| RH | relative humidity |
| SIL | silane |
| ST | strip time is the time interval between when the shaping of the mix in the pattern is completed and the time and when the shaped mixture can no longer be effectively removed from the pattern, and is determined by the Green Hardness tester |
| WT | work time is the time interval between when mixing begins and when the mixture can no longer be effectively shaped to fill the mold or core and is determined by the Green Hardness tester |

EXAMPLES

The examples will illustrate specific embodiments of the invention. These examples, along with the written description, will enable one skilled in the art to practice the invention. It is contemplated that many other embodiments of the invention will be operable besides these specifically disclosed.

The foundry binders are used to make foundry cores by the no-bake process using a liquid curing catalyst (toluene sulfonic acid or benzene sulfonic acid) to cure the furan binder. All parts are by weight and all temperatures are in ° C. unless otherwise specified.

Foundry mixes were prepared by mixing 4000 parts of Wedron 540 sand and 14.4 parts of a toluene sulfonic acidibezene sulfonic acid mixture catalyst for 2 minutes. Then the binders described in the tables were added and mixed for 2 minutes. The foundry mixes tested had sufficient flowability and produced workable foundry shapes under the test conditions.

The resulting foundry mixes were used to fill core boxes to make dogbone testing samples. Test shapes (dogbone shapes) were prepared to evaluate the sand tensile development and the effectiveness of the test shapes in making iron castings. Testing the tensile strength of the dogbone shapes enables one to predict how the mixture of sand and binder will work in actual foundry facilities. The dogbone shapes were stored at 1 hr, 3 hrs, and 24 hrs in a constant temperature room at relative humidity of 50% and a temperature of 25 C. before measuring their tensile strengths. Unless otherwise specified, the tensile strengths were also measured for the dogbone shapes after storing them 24 hrs at a relative humidity (RH) of 90%.

Example 1 and Control A

Comparison of Furan Binders With and Without Bisphenol A and Resorcinol

Example 1 shows the need for using bisphenol A and resorcinol in the binder formulation. Control A is a standard furan binder used commercially.

TABLE I

| Test conditions | | |
|---|---|---|
| Sand: | Wedron 540 sand | |
| Binder: | 1.2% based on the sand weight | |
| CAT: | 30% based on the binder weight | |
| Binder Formulation | | |
| | Control A | Example 1 |
| FA | 73.57 | 66.08 |
| PP | 16.20 | 5.50 |
| FURAN | 10.00 | 15.00 |
| SIL | 0.23 | 0.13 |
| BisA | — | 9.90 |
| RES | — | 3.39 |
| Total | 100.0 | 100.00 |
| Test Results | | |
| | Control A | Example 1 |
| WT/ST (minutes) | 11.0/19.0 | 7.0/10.2 |
| Tensile Strength (psi) | | |
| 15 minutes | 19 | 37 |
| 30 minutes | 50 | 91 |
| 1 hour | 101 | 152 |

The tests results indicate that test cores made with the binder of Example 1, containing bisphenol A and resorcinol, cure significantly faster (as evidenced by the shorter work time and strip time) and have higher initial tensile strengths than a typical high-speed furan binder (Control A). As is shown in the above example, the cores prepared by this invention can be stripped twice as fast as those made from a conventional traditional high-speed furan binder.

Example 2 and Control B and C

Comparison of Furan Binders With and Without Polyester Polyol

Example 2 and Control B show the significance of using a polyester polyol in the furan binder formulation. Example 2 and Control C show the significance of using bisphenol A in the furan binder formulation. The conditions, binder formulations, and test results are set forth in Table II.

TABLE II

| Test conditions | | | |
|---|---|---|---|
| Sand: | Wedron 540 sand | | |
| Binder: | 1.0% based on the sand weight | | |
| Catalyst: | 30% based on the binder weight | | |
| Binder Formulation | | | |
| | Example 2 | Control B | Control C |
| FA | 66.08 | 66.08 | 66.08 |
| PP | 5.50 | — | 15.40 |
| FURAN | 15.00 | 15.00 | 15.00 |
| Silane | 0.13 | 0.13 | 0.13 |
| Bis A | 9.90 | 15.40 | — |
| RES | 3.39 | 3.39 | 3.39 |
| Total | 100.00 | 100.00 | 100.00 |
| Test Results | | | |
| | Example 2 | Control B | Control C |

TABLE II-continued

| | | | |
|---|---|---|---|
| WT/ST (minutes) | 5.5/7.8 | 4.8/7.0 | 7.5/11.5 |
| Tensile Strength (psi) | | | |
| 1 hour (psi) | 216 | 144 | 278 |
| 3 hours (psi) | 237 | 161 | 290 |
| 24 hours (psi) | 166 | 129 | 222 |
| 24 hours @ 90% RH | 130 | 84 | 147 |

The tests results indicate that the test cores made with the binder of Example 2, containing the polyester polyol and bisphenol A, have higher initial tensile strength than furan binders Control B, which did not contain a polyester polyol. They further indicate that binder of Example 2 cures significantly faster than the binder of Control C, which did not contain bisphenol A. Thus, these experiments indicate that the furan binder of this invention, containing both the polyester polyol and bisphenol A, achieves both the requirements of fast reactivity (shorter worktime and striptime) and the good tensile strength.

Example 3 and Control D

Furan Binders Using Another Polyester Polyol

Example 3 demonstrates that other types of polyester polyols (Stepanol 3152) can be used in the binder formulation. Stepanol 3152 is a commercially available aromatic polyester polyol that is the reaction product of phthalic anhydride with diethylene glycol.

TABLE III

| Testing conditions | | | |
|---|---|---|---|
| Wedron 540 sand | | | |
| Binder: | 1.0% based on the sand weight | | |
| Catalyst: | 30% based on the binder weight | | |
| Binder Formulation | | | |
| | Example 3 | Control D | Control E |
| Furfuryl alcohol | 66.08 | 66.08 | 66.08 |
| Resorcinol | 3.39 | 3.39 | 3.39 |
| Silane 1506 | 0.13 | 0.13 | 0.13 |
| Bisphenol A | 9.90 | 15.40 | — |
| Stepanol 3152 | 5.50 | — | 15.40 |
| CR-275 | 15.00 | 15.00 | 15.00 |
| Total | 100.00 | 100.00 | 100.00 |
| Test Results | | | |
| WT/ST (minutes) | 8.0/13.8 | 6.8/10.8 | 16.8/25.0 |
| Tensiles | | | |
| 1 hour (psi) | 157 | 70 | 116 |
| 3 hours (psi) | 232 | 131 | 235 |
| 72 hours (psi) | 290 | 140 | 216 |
| 72 hrs + 24 hr. @ 90% RH | 144 | 62 | 135 |

The tests results indicate that the test cores made with the binder of Example 3, containing the Stepanol 3152 polyester polyol and bisphenol A, have higher initial tensile strength than furan binders Control D, which did not contain a polyester polyol. They further indicate that binder of Example 3 cures significantly faster than the binder of Control E, which did not contain bisphenol A. Thus, these experiments are further confirmation that the furan binder of this invention, containing both the polyester polyol and bisphenol A, achieves both the requirements of fast reactivity (shorter worktime and striptime) and the good tensile strength.

Example 4 and Control E

Comparison of Furan Binders With Phenolic Urethane Binder

Example 4 compares the furan binder of Example 2 under the test conditions set forth in Example 2 to a high-speed commercially available and successful phenolic-urethane binder system sold as PEPSET® 2105/2210/3501 system by Ashland Inc.

TABLE IV

| Test Conditions | | |
|---|---|---|
| PEPSET ® binder: | | |
| Binder: | 1.0% based on the sand weight | |
| Ratio: | Part I/II = 62/38 | |
| Catalyst: | 3% liquid tertiary amine based on the Part I | |
| Test Results | | |
| | Example 4 | PEPSET ® binder (Control E) |
| WT/ST(minutes) | 5.8/8.3 | 5.0/6.3 |
| Tensile strength | | |
| 1 hour (psi) | 162 | 162 |
| 3 hours (psi) | 191 | 167 |
| 24 hours (psi) | 243 | 259 |
| 24 hrs @ 90% RH | 124 | 60 |

The data in Table IV indicate that the binder of Example 4 possesses a cure speed and comparable to the phenolic urethane system. Moreover, the test cores made with the binder have comparable tensile strengths and the their resistance to humidity is much better than the cores prepared with the phenolic urethane binder.

I claim:

1. A furan no-bake binder comprising:

(a) a reactive binder component selected from the group consisting of furfuryl alcohol, reactive furan resins, and mixtures thereof, (b) an activator selected from the group consisting of resorcinol, resorcinol pitch, and bisphenol A tar, (c) a bisphenol compound, and (d) a polyol selected from the group consisting of polyester polyols, polyether polyols, and mixtures thereof.

2. The binder of claim 1 wherein the reactive binder component is a mixture of furfuryl alcohol and a reactive furan resin.

3. The binder of claim 2 that also contains a silane.

4. The binder of claim 1 wherein the binder comprises: (a) from about 1 to about 50 parts by weight a reactive furan resin, (b) from about 10 to about 80 parts by weight furfuryl alcohol, (c) from about 0.1 to about 20 parts by weight resorcinol, (d) from about 1 to about 30 parts by weight a bisphenol, (d) from about 0.1 to about 30 parts of a polyol, and (f) from about 0.01 to about 10 parts by weight a silane, wherein said parts of the binder components are by weight are based upon 100 parts the weight of the binder.

5. The binder of claim 4 wherein the polyol is an aromatic polyester polyol has a hydroxyl number of about 700 to 1200.

6. The binder of claim 5 wherein the polyester polyol is the reaction product of an aromatic polyester selected from the group consisting of phthalic anhydride and polyethylene terephthalate and a glycol selected from the group consisting of ethylene glycol and diethylene glycol.

7. The binder of claim 6 wherein the activator is resorcinol.

8. The binder of claim 7 wherein the bisphenol compound is bisphenol A.

9. The binder of claim 8 wherein the polyester polyol has a hydroxyl number of about 700 to 1200.

10. The binder of claim 9 wherein the binder comprises: (a) from about 2 to about 30 parts by weight a reactive furan resin, (b) from about 20 to about 75 parts by weight furfuryl alcohol, (c) from about 0.5 to about 10 parts by weight resorcinol, (d) from about 2 to about 15 parts by weight a bisphenol, (e) from about 2 to about 20 parts of a polyester polyol, and (f) from about 0.05 to about 5 parts by weight a silane, wherein said parts of the binder components are by weight are based upon 100 parts the weight of the binder.

11. A foundry mix comprising:

A. a major amount of foundry aggregate;

B. an effective binding amount of a foundry binder of claims 1, 2, 3, 4, 5, 6, 7, 8, 9, or 10; and C. an effective binding amount of a liquid furan curing catalyst.

* * * * *